United States Patent [19]

Morrison et al.

[11] 4,306,841

[45] Dec. 22, 1981

[54] PUMP MOUNTING FOR AN AUTOMATIC WASHER

[75] Inventors: Russell J. Morrison, St. Joseph; William Ohmann, St. Joseph Township, Berrien County, both of Mich.

[73] Assignee: Whirlpool Corporation, Benton Harbor, Mich.

[21] Appl. No.: 116,901

[22] Filed: Jan. 30, 1980

[51] Int. Cl.[3] ..... F04B 17/00; D06F 17/02

[52] U.S. Cl. ..... 417/360; 248/672; 68/184

[58] Field of Search ..... 40/360, 363; 248/639, 248/672; 68/184; 310/67 R

[56] References Cited

U.S. PATENT DOCUMENTS

| | | | |
|---|---|---|---|
| 2,047,330 | 7/1936 | Petersen . | |
| 2,688,930 | 9/1954 | De Moss . | |
| 2,695,747 | 11/1954 | Miller | 417/360 X |
| 2,807,395 | 9/1957 | Korte . | |
| 2,867,173 | 1/1959 | Lung . | |
| 3,491,696 | 1/1970 | Howard | 417/360 |
| 3,516,627 | 6/1970 | Gable et al. | 248/639 |
| 3,604,820 | 9/1971 | Scheller et al. | 417/360 UX |
| 3,814,086 | 6/1974 | Lemb | 417/424 |
| 4,211,519 | 7/1980 | Hogan | 417/360 |

*Primary Examiner*—Richard E. Gluck

*Attorney, Agent, or Firm*—Hill, Van Santen, Steadman, Chiara & Simpson

[57] ABSTRACT

A means for mounting a pump to a motor is provided by forming a plurality of legs on the bottom side of a pump which abut the motor housing and space the pump axially and radially with respect to the motor, and providing spring clamp means to removably secure the pump to the motor.

8 Claims, 11 Drawing Figures fig. 1
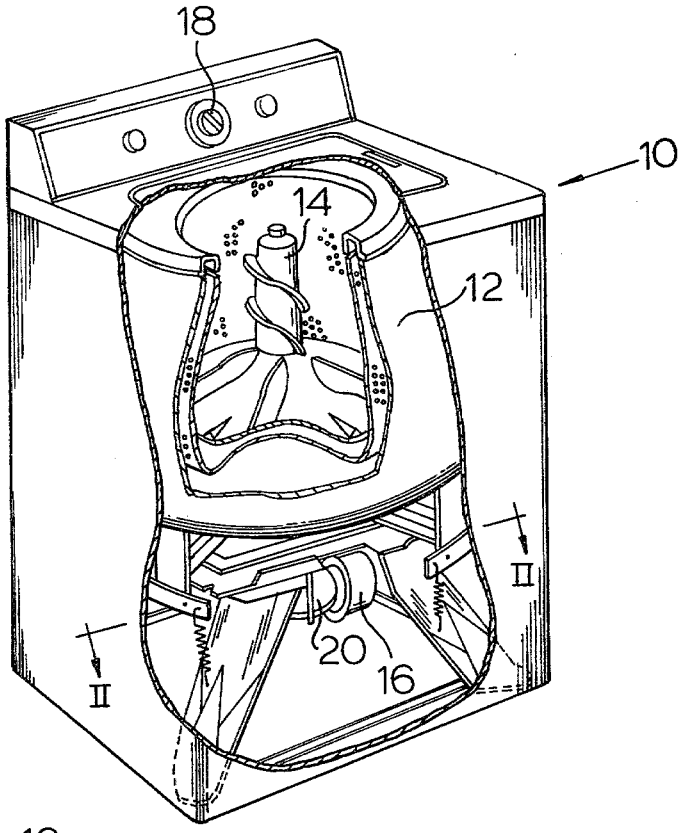
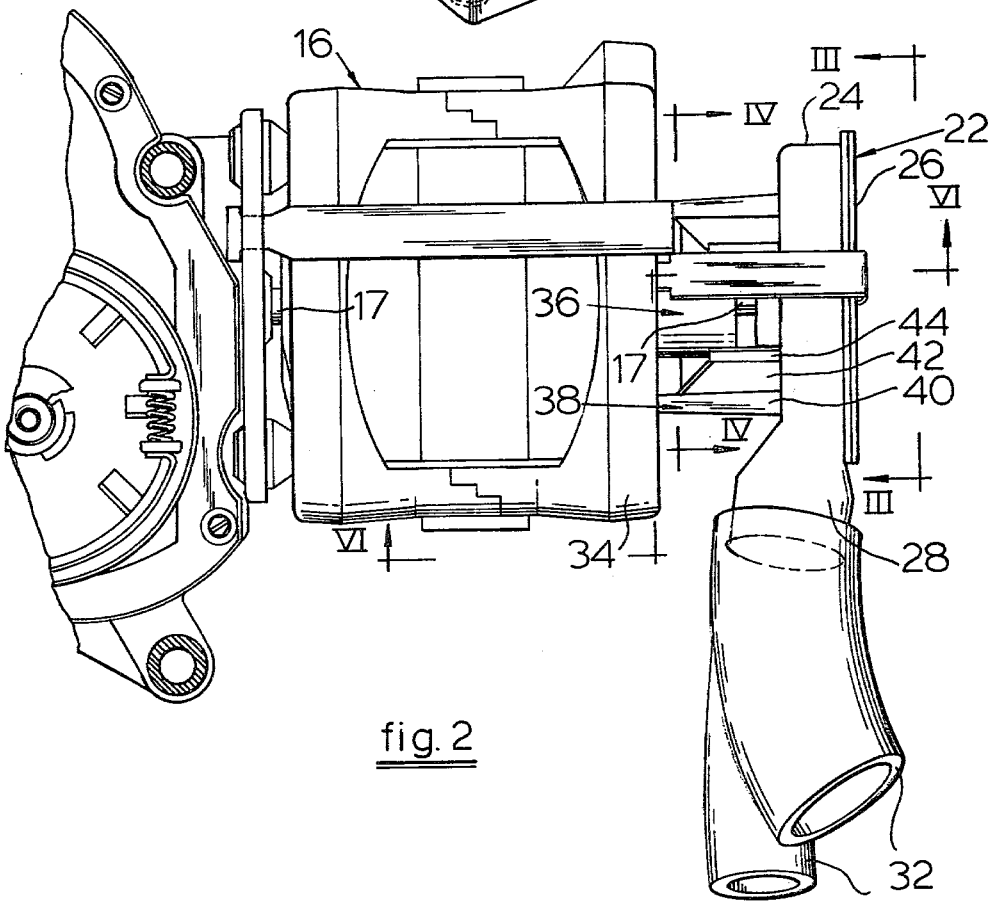
fig. 2

PUMP MOUNTING FOR AN AUTOMATIC WASHER

BACKGROUND OF THE INVENTION

1. Field of the Invention

This invention relates to a means for mounting a pump to a motor and more particularly to a means for mounting a water pump to the motor in an automatic washing machine.

2. Description of the Prior Art

Pumps having an impeller mounted directly on a motor shaft are disclosed in U.S. Pat. No. 2,867,173 issued to K. R. Lung and U.S. Pat. No. 2,807,395 issued to A. C. Korte.

U.S. Pat. No. 3,814,086 issued to J. Lemb discloses a pump having an impeller mounted directly on a motor shaft and also shows generally the mounting of a pump and a motor on a common housing. U.S. Pat. No. 2,688,930 issued to A. H. DeMoss discloses a pump having an impeller mounted directly on a motor shaft and also discloses a pump housing held together by spring clips. U.S. Pat. No. 2,047,330 issued to T. Petersen discloses a motor and pump assembly wherein a pump housing is clamped in place by a pivoted clamp arm.

SUMMARY OF THE INVENTION

This invention involves a means for mounting a water pump to a motor in an automatic washing machine wherein the pump is mounted on the opposite end of the drive motor from the transmission. The pump impeller is mounted directly on and driven by the motor shaft. A pump housing made of thermoplastic material has both an inlet and discharge port formed thereon and a pump cover, heat sealed to the pump housing, is provided with a thrust bearing against which the impeller is journalled. A face seal engages the impeller around the motor shaft to prevent water leakage.

The pump housing is provided with four legs which locate the housing relative to the motor both radially and axially. Each leg is provided with a curved portion which is snug against the motor bearing housing such that the combination of the four curved portions locate the pump housing radially with respect to the motor shaft. Each leg is further provided with a foot portion which extends parallel to the motor shaft and bears against the motor housing to locate the pump housing axially with respect to the motor shaft.

In one form of the invention two flat leaf springs are used to clamp the pump housing to the end of the motor housing. Alternative embodiments provide for a one-piece formed wire spring or two extension springs to clamp the pump housing to the end of the motor housing. The pump mounting provides a pump which is easily assembled to the motor, accurately positioned with respect to the motor and shaft, and which is rigidly held in place such that movement of the motor with respect to the inlet and outlet hoses connected to the inlet and outlet ports of the pump does not cause movement of the pump with respect to the motor. Thus, the legs and the pump housing locate the pump radially and in one axial direction with respect to the motor and a simple spring clamping means solidly connects the pump housing to the motor.

DESCRIPTION OF THE DRAWINGS

FIG. 1 is a perspective view of a washing machine with a partial cut-away to show the mechanical means within the washing machine including a tub with a vertical agitator and a motor with a pump attached.

FIG. 2 is a plan view of the motor and pump taken along line II—II of FIG. 1.

DESCRIPTION OF THE PREFERRED EMBODIMENTS

Figure 3:
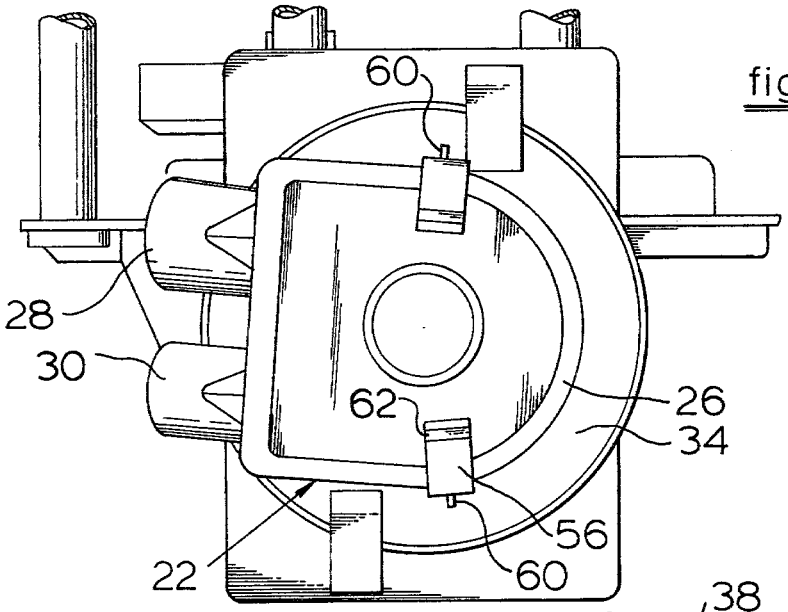
FIG. 3 is an end view of the pump and motor assembly taken along line III—III of FIG. 2.

In FIG. 1 a washing machine is generally shown at 10 as having a tub 12 with a vertical agitator 14 therein, a water supply (not shown), an electrically driven motor 16 operably connected via a transmission 20 to the agitator 14, and controls 18 including a pre-settable sequential control means for use in selectively operating the washing machine 10 through a programmed sequence of washing, rinsing and drying steps.

Referring to FIG. 2 the motor 16 with a pump 22 attached thereto by the mounting means contemplated by the invention is shown in greater detail. The motor 16 has a housing 33 with an end bell 34 and a cylindrical shaft bearing support 36 on an end opposite the transmission 20.

Figure 4:
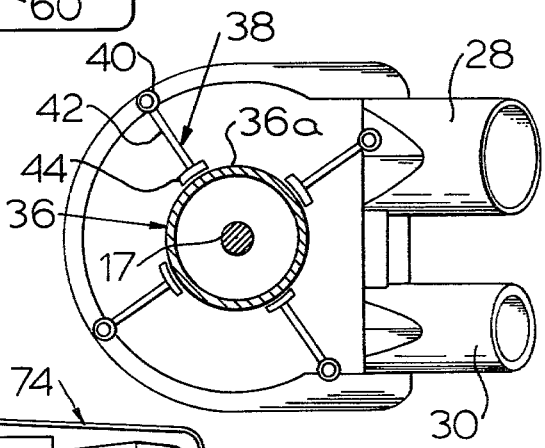
FIG. 4 is an end view of the pump taken along line IV—IV of FIG. 2.

The pump 22, as seen in FIGS. 2, 3 and 4, comprises a housing 24 with a cover 26, an inlet port 28 and an outlet port 30. A pair of rubber hoses 32 connect the inlet 28 and the outlet 30 to the tub 12 and a drain (not shown). The pump 22 is removably mounted on a shaft 17 of the motor 16 and spaced apart therefrom by means of a plurality of legs 38 formed to extend from the bottom of the pump housing 24. The legs 38 are each comprised of a foot portion 40, and a radial portion including an arcuate portion 44 and a spacer portion 42 extending radially inward from the foot portion 40 to the arcuate portion 44. The foot portion 40 is of a cylindrical shape, and extends generally parallel to the shaft 17 of the motor 16. An end of said foot 40 thereof abuts in mating relation with the end bell 34 of the motor 16 such that the leg 38 spaces the pump 22 in an axial direction from the motor 16. The arcuate portion 44 of the legs 38 form an interior surface generally parallel to a cylindrical outer surface **36*a* of the shaft bearing support 36 and mate therewith to space the pump 22 radially with respect to the shaft 17 of the motor 16**. A spring clamp retaining means 48 is used to secure the pump 22 to the motor 16.

Figure 6:
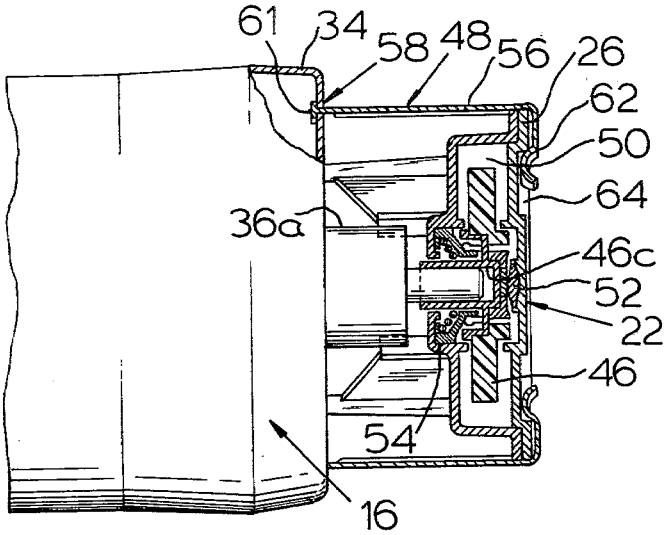
FIG. 6 is a partial cross section view of the pump and motor taken along line VI—VI of FIG. 2.

The pump 22, as seen in FIG. 6, is comprised of an impeller 46 within a pump chamber 50 having bearing means 52 for spacing the impeller 46 relative to the pump housing 24. An end 17*a* of shaft 17 is provided with a flat portion (not shown) and is fitted within a complementary recess 46*c* in impeller 46 forming a coupling means for the impeller and shaft. The impeller 46 is thus rotatably driven by the drive shaft 17 of the motor 16. A sealing means 54, which bears against the impeller 46, is provided around the drive shaft 17 to prevent water leakage.

Figure 7:
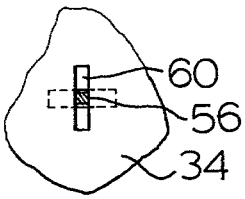
FIG. 7 is an enlarged partial view of the spring attachment to the motor housing as shown in FIG. 6.

In the embodiment shown in FIGS. 1 to 7 the spring clamp retainer means 48 for securably attaching the pump 22 to the motor 16 is comprised of two flat leaf springs 56. The leaf springs 56 attach to the end bell 34 of the motor 16 by way of a T-bar means 58 between the leaf spring 56 and the end bell 34. An example of such a T-bar means is shown in FIG. 7 which comprises a female portion such as a slot 60 formed in the end bell 34 of the motor 16 to receive a male portion 61 which conveniently comprises an end of the leaf spring 56 having a portion cut away (not shown) so that the end 61 of the leaf spring 56 is captured within the slot 50 of the end bell 34 after the leaf spring has been inserted into the slot 60 and rotated 90 degrees.

The other end of the leaf spring 56 has a protrusion 62 mating with a recess 64 formed in the cover 26 of the pump 22.

The pump housing 24 and the cover 26 are made of thermoplastic material. Thus, the cover 26 may be permanently bonded in sealed together relationship with the housing 24 by heat sealing.

To remove the pump 22 from the motor 16 a serviceman need only spring the protrusions 62 out of the recess 64 formed in the cover 26. This allows for easy removal of the pump 22 since the two leaf springs 56 comprise the sole retaining means for retaining the pump 22 on the shaft 17 of the motor 16.

Figure 8:
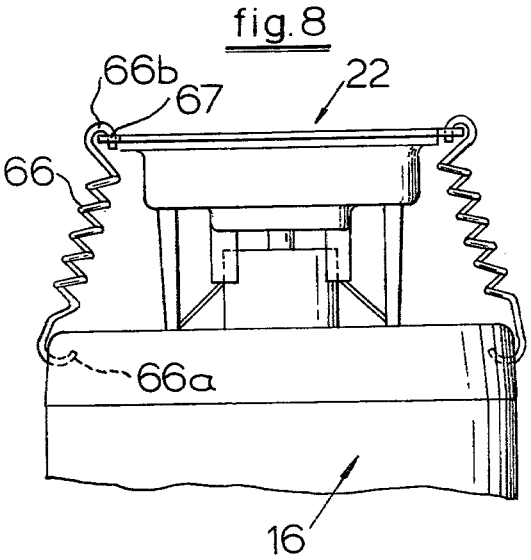
FIG. 8 is an alternative embodiment of the invention showing extension springs holding the pump to the motor.
Figure 9:
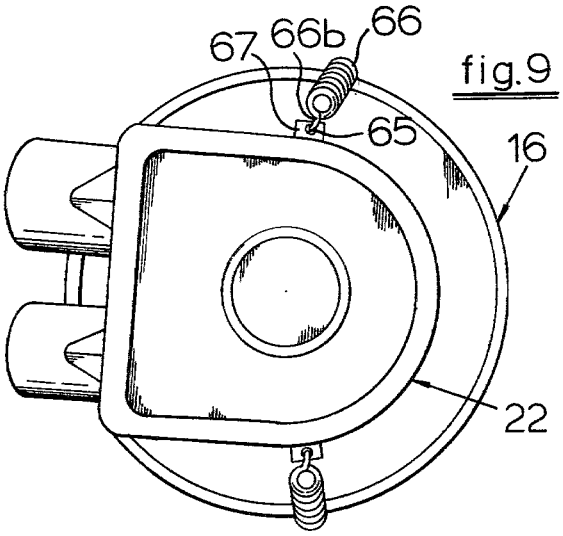
FIG. 9 is an end view of the alternative embodiment shown in FIG. 8.

An alternative spring clamp retainer means is shown in FIGS. 8 and 9 comprising a pair of extension springs 66, one end 66*a* of which is captured in a hole (not shown) formed in the end bell 34 of the motor 16 while the other end 66*b* of the extension spring 66 hooks into a hole 65 in an ear 67 formed on the housing 24 of the pump 22.

Figure 10:
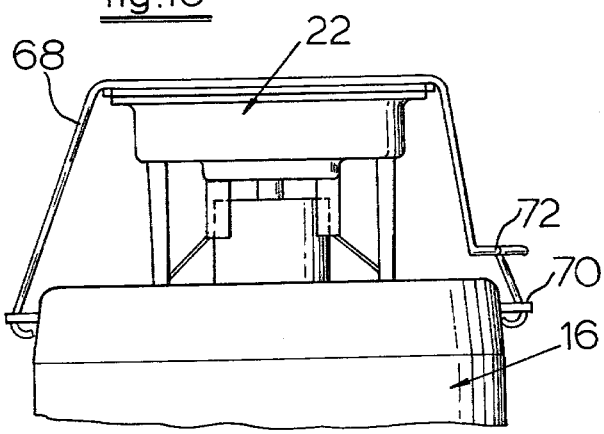
FIG. 10 is a side view of an alternative embodiment of the invention showing a single wire formed spring attaching the pump to the motor.
Figure 11:
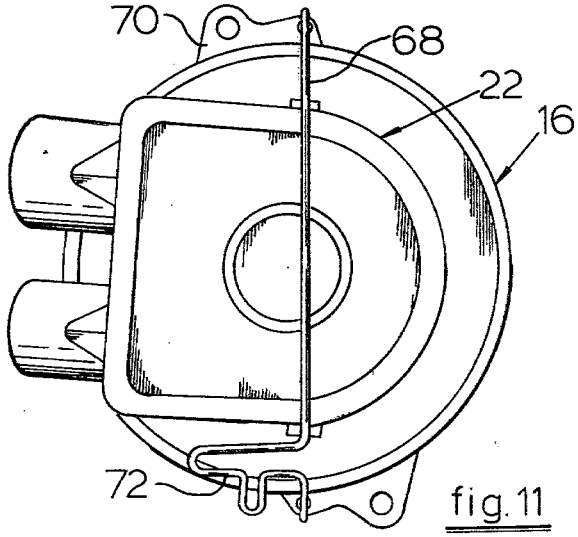
FIG. 11 is an end view of the alternative embodiment shown in FIG. 10.

A third embodiment of the spring retainer means is shown in FIGS. 10 and 11 and comprises a one-piece formed wire spring 68, both ends of which attach to diametrically opposite brackets 70 formed on the end bell 34 of the motor 16. The wire spring 68 is formed so that it crosses the cover 26 of pump 22 and has formed therein a bight 72 to allow for quick release of the spring 68.

Figure 5:
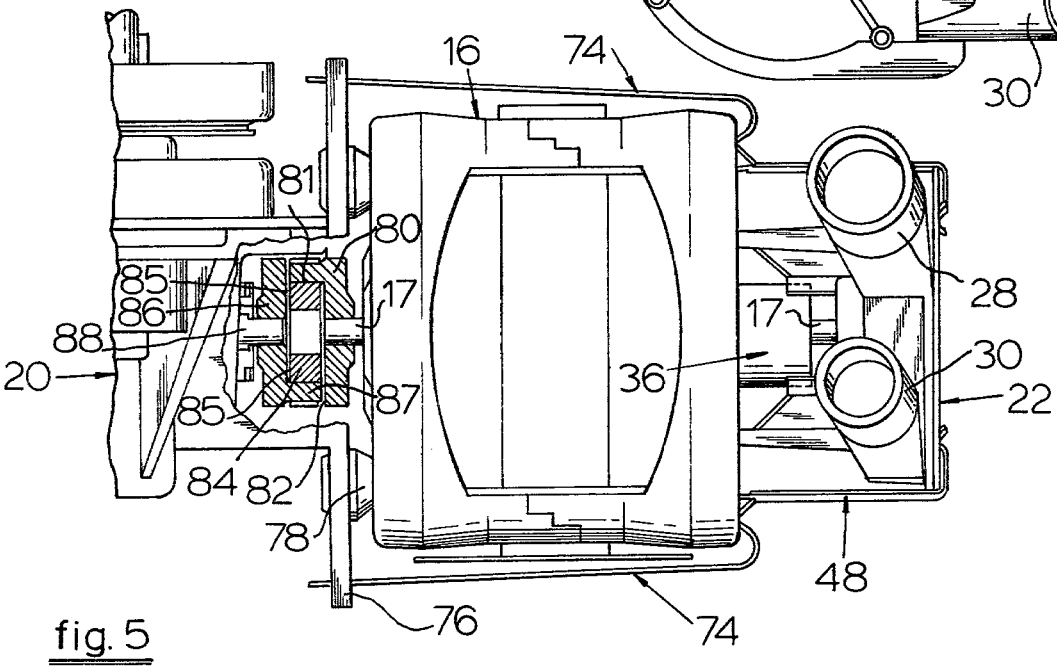
FIG. 5 is a side view of the motor and pump assembly of FIG. 2 with a partial cross section showing the motor connection with the transmission.

In FIG. 5, the pump 22 and motor 16 assembly is shown with the spring retainer means 48 securing the pump 22 to the motor 16. A second mounting means 74 is also shown securing the motor 16 to a frame 76 containing the transmission 20. The second mounting means 74 is similar in construction and function to the pump mounting means as described above. A plurality of isolators 78 are provided in the frame 76 to abut against the motor 16 when it is securely mounted to frame 76 to provide vibration dampening and a resilient surface to aid in the mounting of the motor 16. The drive shaft 17 of the motor 16 is keyed to a first driving disc 80 having fingers 81 projecting in an axial direction away from a surface 82 of the first driving disc 80. The fingers 81 of the first driving disc 80 are received in a second driving disc 84 having apertures 85 for receiving the fingers 81. The second driving disc 84 is made of a rubber or other resilient material. A third driving disc 86 having fingers 87 similar to fingers 81 is provided on the opposite side of the second driving disc 84 in a manner similar to the mating of first driving disc 80 and second driving disc 84. The third driving disc 86 is keyed to a second drive shaft 88 which operably connects with the transmission 20.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

Embodiments of the invention in which an exclusive property or privilege is claimed are defined as follows:

1. For use in an automatic laundry appliance,
   an electrically driven motor having a housing including a shaft bearing support and a rotatable drive shaft projecting therefrom,
   a pump having a housing including a plurality of legs mating with said bearing support and said motor housing, said pump including impeller means for pressurizing liquid used in said appliance,
   coupling means for operatively connecting said motor and said pump in driving relationship, and
   spring clamp means constituting the sole retainer means for selectively locking said pump and said motor in coupled relationship.

2. The combination of claim 1 wherein, said motor housing forms a slot,
   said pump housing having a recess, and
   said spring clamp means comprising a leaf spring, one end of said leaf spring being retained in said slot, the other end of said leaf spring having a protrusion mating with said recess.

3. The combination of claim 1 wherein,
   said pump housing is provided with a pair of diametrically opposed ears forming apertures therein, and
   said spring clamp means comprises a pair of extension springs, one end of each of said springs retained in said motor housing, the other end of said extension spring retained in said pump housing ear aperture.

4. The combination of claim 1 wherein,
   said pump housing has formed thereon a plurality of legs,
   said legs comprising a foot portion extending generally parallel to said motor drive shaft and having an end in abutting relationship with said motor housing to space said pump an axial distance from said motor,
   a spacer portion extending radially inward from said foot portion and terminating in an arcuate portion, and
   said arcuate portion having an inner surface generally parallel to an outer surface of a bearing support for said motor shaft, said arcuate portion mating with said shaft bearing support to align said pump axially with respect to said shaft of said motor.

5. In an automatic washing machine having a tub for receiving a clothes load, a water supply to provide water to said tub, an agitator for agitating said clothes load, a motor having an axial drive shaft for driving said agitator, said motor having a housing including an end bell and a shaft bearing support, and a pump impeller connected to and driven by said shaft, a pump mounting means for mounting said pump impeller relative to said motor, said mounting means comprising:

a pump housing surrounding said pump impeller and having an inlet connected to said tub and an outlet connected to a drain, said pump housing defining a pump chamber and having bearing means for spacing said impeller relative to said housing;

a plurality of legs projecting from said pump housing, said legs having an axial portion projecting generally parallel to said shaft to bear against said motor housing for spacing said pump housing from said motor housing, said legs including a radial portion projecting radially inwardly from said axial portion to bear against said motor shaft bearing support for locating said pump housing radially with respect to said shaft; and spring clamp retainer means connected between said pump housing and said motor housing for locking said pump housing to said motor housing.

6. The pump mounting means of claim 5 wherein said shaft bearing support has an outer cylindrical surface and said radial portion comprises an arcuate portion mating with said surface and a spacer portion extending from said leg axial portion to said arcuate portion.

7. The pump mounting means of claim 5 or claim 6 wherein said spring clamp retainer means comprises a pair of extension springs.

8. The pump mounting means of claim 5 or claim 6 wherein said spring clamp retainer means comprises a pair of leaf springs.

* * * * *